US008454104B2

(12) United States Patent
Pallo

(10) Patent No.: US 8,454,104 B2
(45) Date of Patent: Jun. 4, 2013

(54) SPLIT-BODIED INSULATED CAVITY FOR A FILE CABINET

(75) Inventor: R. David Pallo, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 60 days.

(21) Appl. No.: 12/862,193

(22) Filed: Aug. 24, 2010

(65) Prior Publication Data

US 2012/0049714 A1 Mar. 1, 2012

(51) Int. Cl.
*A47B 96/04* (2006.01)

(52) U.S. Cl.
USPC ..... 312/409; 312/330.1

(58) Field of Classification Search
USPC ..... 312/406, 409, 402, 330.1, 403; 109/47, 109/53, 54, 57, 81; 220/560.01
See application file for complete search history.

(56) References Cited

U.S. PATENT DOCUMENTS

| | | | | | |
|---|---|---|---|---|---|
| 1,902,795 | A | | 3/1933 | Wolters | |
| 2,333,511 | A | * | 11/1943 | Bates et al. | 109/53 |
| 3,095,838 | A | * | 7/1963 | Paulos et al. | 109/80 |
| 3,408,966 | A | * | 11/1968 | Gartner | 109/74 |
| 3,705,754 | A | * | 12/1972 | Drum et al. | 312/409 |
| 3,817,589 | A | * | 6/1974 | Anderson | 312/409 |
| 3,826,552 | A | * | 7/1974 | Anderson | 312/409 |
| 3,855,741 | A | * | 12/1974 | Semon | 52/19 |
| 3,888,557 | A | * | 6/1975 | Anderson et al. | 312/409 |
| 4,303,286 | A | * | 12/1981 | McClellan | 312/409 |
| 4,413,869 | A | * | 11/1983 | Pichler et al. | 312/236 |
| 4,741,276 | A | * | 5/1988 | Pollock | 109/25 |
| 4,893,397 | A | * | 1/1990 | Hughes | 29/428 |
| 5,152,231 | A | * | 10/1992 | Preston et al. | 109/65 |
| 6,464,313 | B2 | * | 10/2002 | Nishimoto | 312/406 |
| 7,628,113 | B2 | * | 12/2009 | Pallo et al. | 109/75 |
| 2004/0150306 | A1 | * | 8/2004 | Steedly | 312/409 |
| 2007/0252490 | A1 | | 11/2007 | Cleveland et al. | |

FOREIGN PATENT DOCUMENTS

| | | |
|---|---|---|
| GB | 489522 | 7/1938 |
| GB | 2299260 | 2/1996 |

OTHER PUBLICATIONS

Behammer, Frank, "European Search Report," for application No. EP 11 00 6884.8, dated Nov. 18, 201, Munich, Germany.

* cited by examiner

*Primary Examiner* — Darnell Jayne
*Assistant Examiner* — Daniel Rohrhoff
(74) *Attorney, Agent, or Firm* — Woods Oviatt Gilman LLP

(57) ABSTRACT

A file cabinet is provided and comprises an outer housing defining an opening, at least one file drawer assembly slidably disposed within the opening, the at least one file drawer assembly including an open-ended storage box, and a split-bodied fire-resistant cavity including first and second cavity portions. The first cavity portion is mounted within the outer housing, and the second cavity portion is mounted to the file drawer assembly and is configured to surround a portion of the open-ended storage box. A mating interface is provided between the first and second cavity portions. The open-ended storage box is accessible when the at least one file drawer assembly is in an open position. The first and second cavity portions are configured to join together at the mating interface to entirely surround the open-ended storage box when the at least one file drawer assembly is in a closed position.

22 Claims, 7 Drawing Sheets

SPLIT-BODIED INSULATED CAVITY FOR A FILE CABINET

BACKGROUND OF THE INVENTION

The present invention relates to fire-rated file cabinets; and more particularly, to a split-bodied insulated cavity for providing local fire-rated space within an otherwise non-fire-rated file cabinet.

Fire-rated file cabinets are well known. Existing fire-rated file cabinets typically comprise a double-walled blow-molded outer housing that defines one or more openings for a file cabinet drawer to be slidably disposed therein. The outer housing globally surrounds the entire file storage space within the cabinet, and therefore requires that a large amount of fire-resistant insulation positioned within an insulation space formed between the blow-molded walls. In addition, the front of the file cabinet drawers may also be blow-molded to include a double-wall defining an insulation space that is filled with fire-resistant insulation to provide fire resistance to the front of the file cabinet drawer when the drawer is in a closed position. While existing fire-rated cabinets are effective at protecting the documents contained therein from fire for a certain period of time, they suffer from a number of drawbacks and deficiencies.

Some of the drawbacks of existing fire-rated file cabinets is that they are expensive to manufacture, heavy, and difficult to move. These drawbacks stem from the fact that a substantial amount of fire-resistant insulation is used to fill the insulation space of the outer housing, which extends around all of the file cabinet drawers. In use, this globally-protected volume may be substantially larger than the local volume or volumes required to protect the actual items to be stored in the file cabinet. In some instances, only a single file drawer of an entire file cabinet may require fire protection.

As such, there is a need for a fire-rated file cabinet that is less expensive to manufacture. There is also a need for a fire-rated file cabinet that uses less fire-resistant insulation. There is a further need for a fire-rated file cabinet that provides a local fire-rated space within an otherwise non-fire-rated file cabinet. The present invention addresses these needs as well as other needs.

BRIEF SUMMARY OF THE INVENTION

Briefly described, a split-bodied fire-insulated cavity in accordance with the present invention comprises first and second fire-insulated cavity portions for installation into a file cabinet and a mating file drawer assembly, respectively. Preferably, an open-ended storage box for receiving items to be protected against fire and water damage is disposed within the second cavity portion. The storage box is fully accessible when the file drawer assembly is in an open position because the mating interface between the first and second cavity portions may extend diagonally therebetween. When the file drawer assembly is moved to a closed position, the first and second cavity portions mate along the interface to define a fire-resistant and a water-resistant space within the file cabinet, wherein the storage box is positioned within such space to protect the contents being stored therein. Thus, the present invention provides a local fire-rated space within the file cabinet thereby reducing substantially the weight of the file cabinet and cost of protecting contents located within the file cabinet compared to existing fire-rated file cabinets.

BRIEF DESCRIPTION OF THE DRAWINGS

The accompanying drawings form a part of this specification and are to be read in conjunction therewith, wherein like reference numerals are employed to indicate like parts in the various views, and wherein.

The exemplification set out herein illustrates one embodiment of the invention, in one form, and such exemplification is not to be construed as limiting the scope of the invention in any manner.

DETAILED DESCRIPTION OF THE INVENTION

Figure 1:
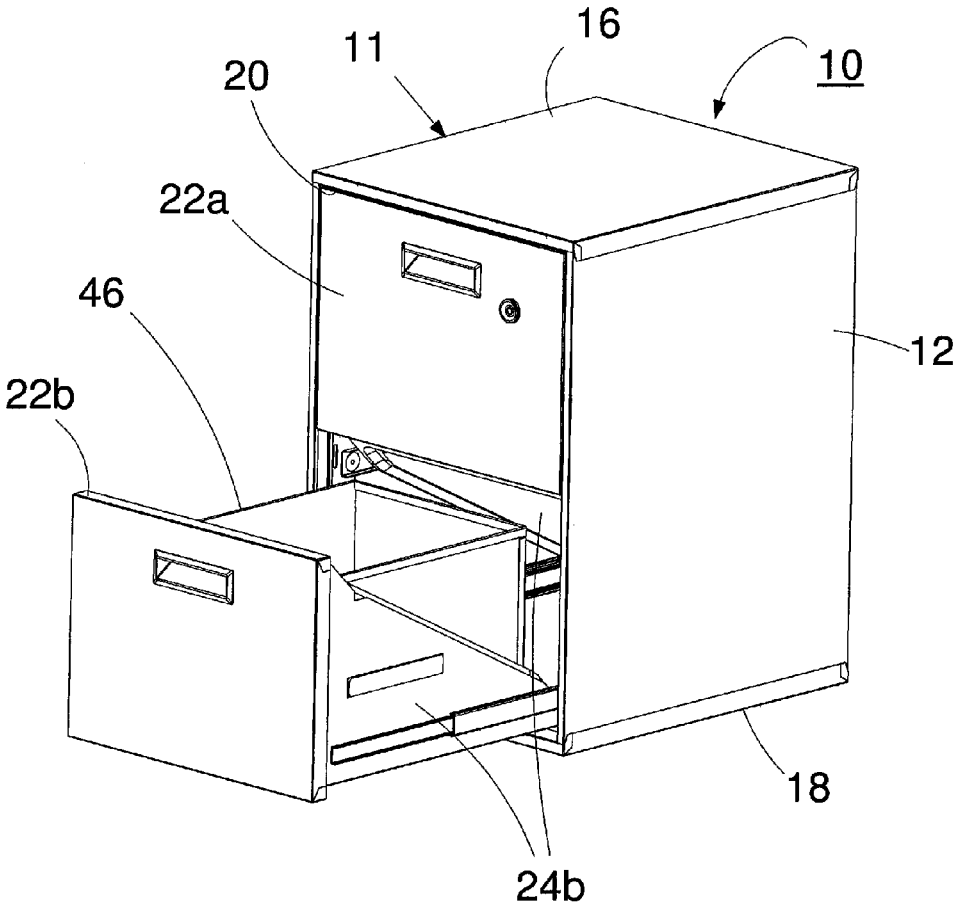
FIG. 1 is a perspective view of a file cabinet equipped with a split-bodied insulated cavity in accordance with the present invention in at least one of the file cabinet drawers.
Figure 2:
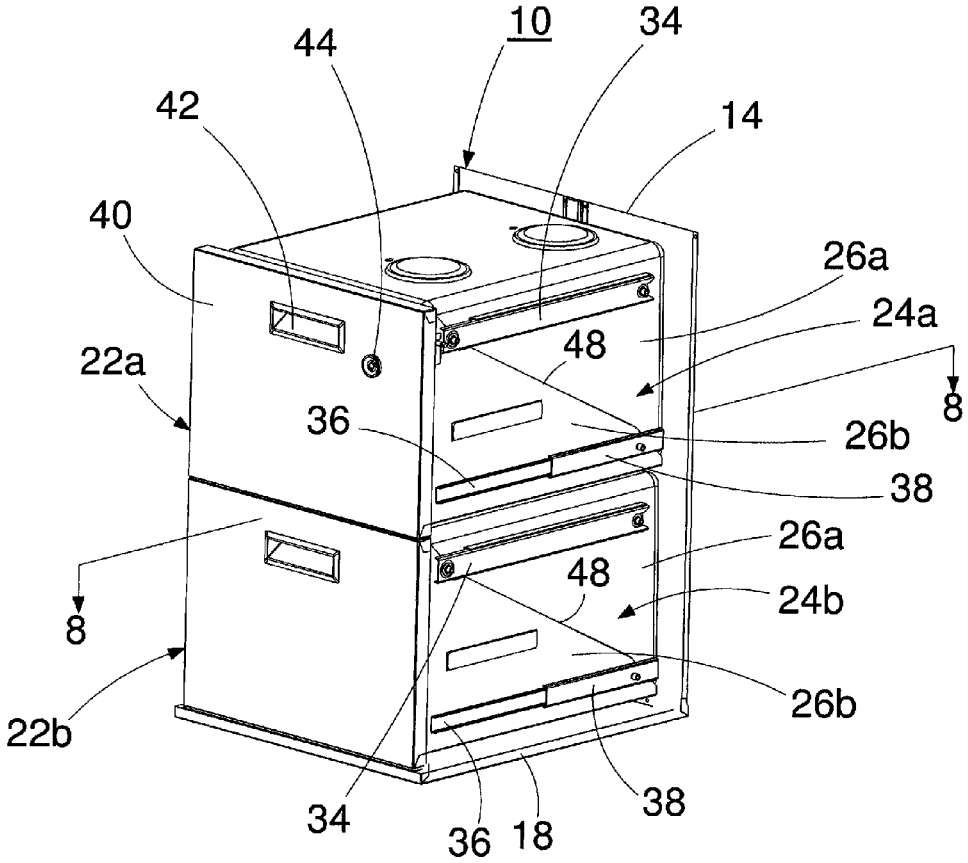
FIG. 2 is a perspective view of the file cabinet shown in FIG. 1 with a portion of its outer housing removed.
Figure 3:
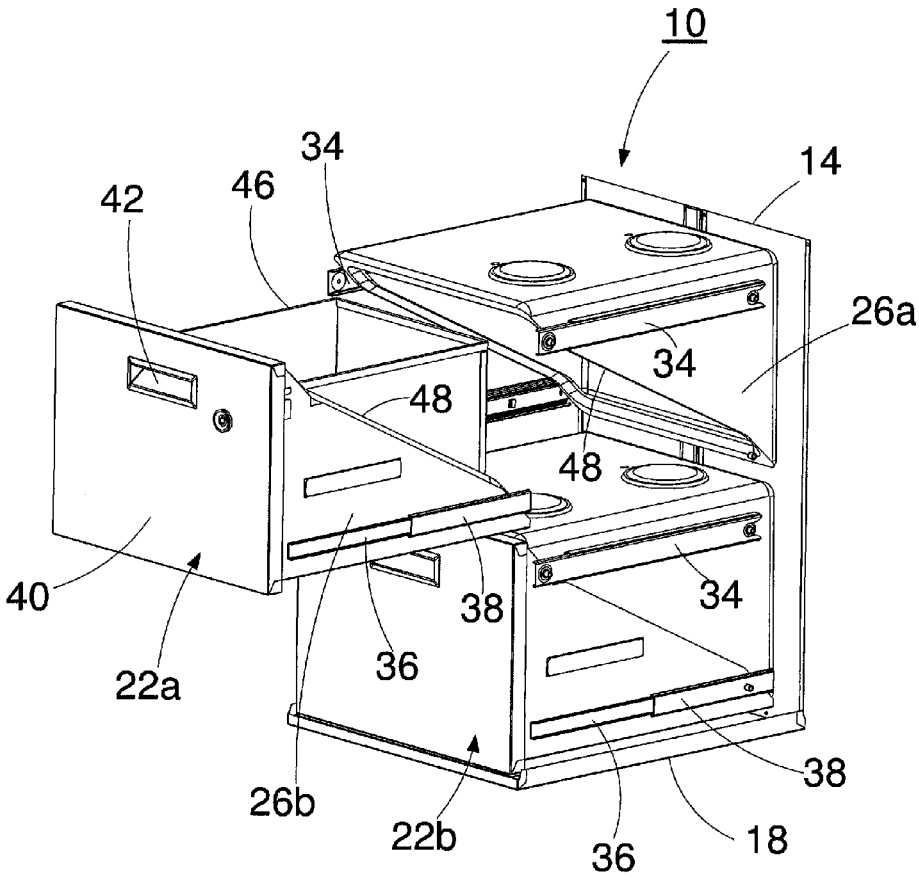
FIG. 3 is a perspective view of the file cabinet shown in FIG. 2 with the top drawer in an open position.

Referring to the drawings in detail, and initially to FIGS. 1-3, reference numeral 10 generally designates an exemplary file cabinet that may be used in conjunction with the present invention. File cabinet 10 may comprise an outer housing 11 including a pair of opposing side walls 12, a back wall 14, a top wall 16, and a bottom support base 18. Outer housing 11 may be formed of, for example, wood, plastic, or metal, such as aluminum. Side walls 12, top wall 16, and bottom support base 18 may define an opening 20 configured to allow at least one of first and second drawer assemblies 22*a*, 22*b* to be slidably moved between opened and closed positions.

Figure 8:
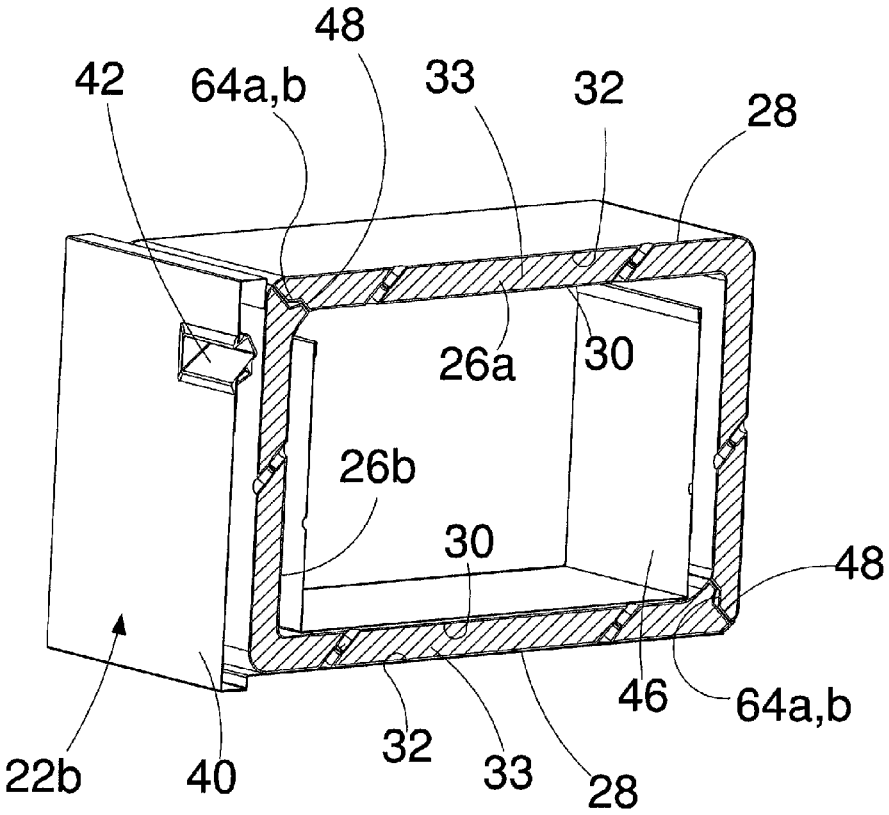
FIG. 8 is a cross-sectional view of a complete split-bodied insulated cavity installed in a closed drawer of a file cabinet taken along line 8-8 in FIG. 2.

In accordance with the present invention, at least one of first and second drawer assemblies 22*a*, 22*b* is equipped with split-bodied fire-resistant cavities 24*a*, 24*b* to provide localized protection for items stored within file cabinet 10. Each split-bodied fire-resistant cavity 24*a*, 24*b* comprises first and second cavity portions 26*a*, 26*b* that are configured to be joined together to protect the contents stored within file cabinet 10 from fire when the respective drawer assembly 22*a*, 22*b* is in a closed position. As best seen in FIG. 8, each of first and second cavity portions 26*a*, 26*b* may be blow-molded to form an outer wall 28 and an inner wall 30 defining an insulation space 32 therebetween. Within insulation space 32 is a thermally insulative fire-resistant material 33, such as, for example, a hydrated Portland cement having between about 40-60% water content and including nylon fibers. While first and second cavity portions 26*a*, 26*b* are shown in the drawings as being substantially equal in size, it should be understood that first and second cavity portions 26*a*, 26*b* may also be of unequal sizes and still provide the benefits set forth herein.

Figure 4:
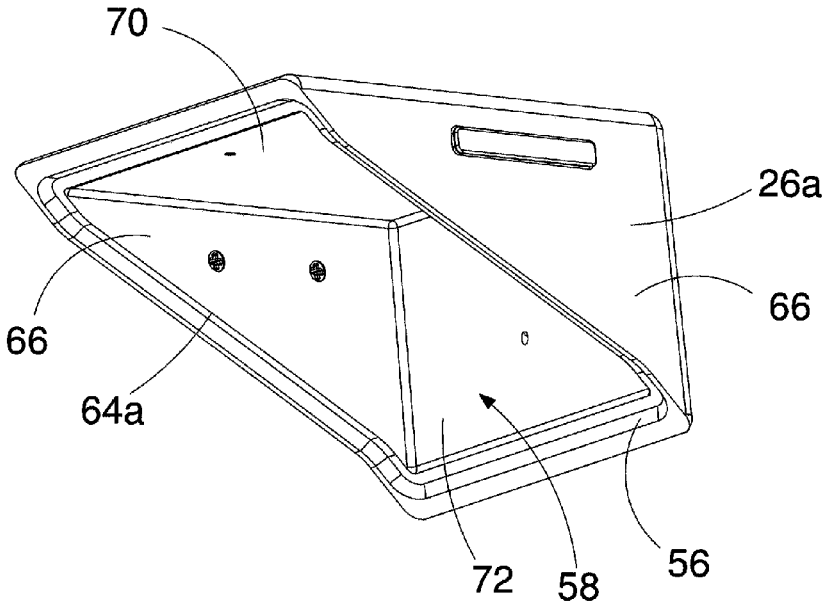
FIG. 4 is a bottom perspective view of a first cavity portion of the split-bodied insulated cavity.
Figure 5:
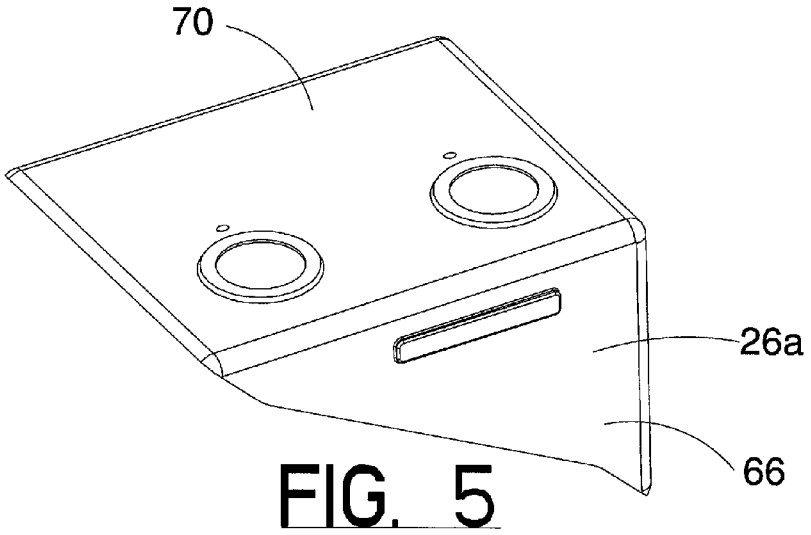
FIG. 5 is a top perspective view of the first cavity portion of the split-bodied insulated cavity shown in FIG. 4.
Figure 6:
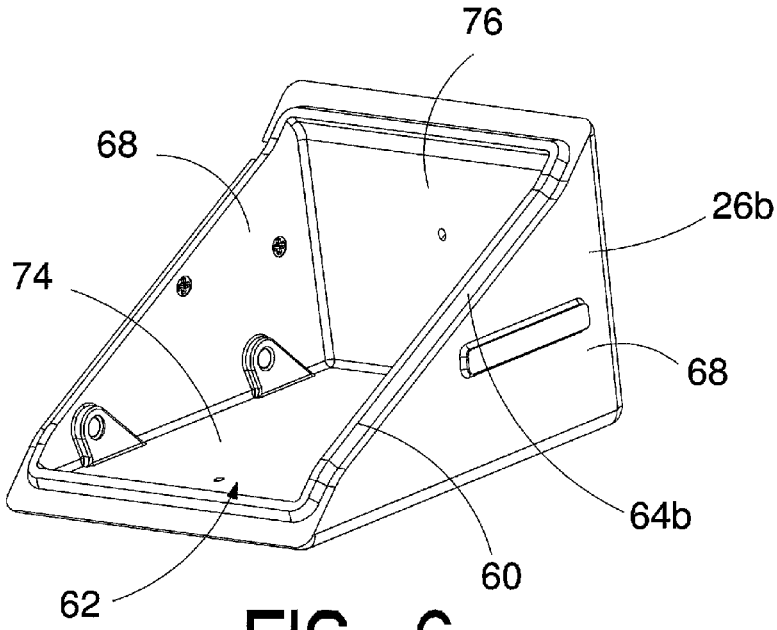
FIG. 6 is a top perspective view of a second cavity portion of the split-bodied insulated cavity.
Figure 7:
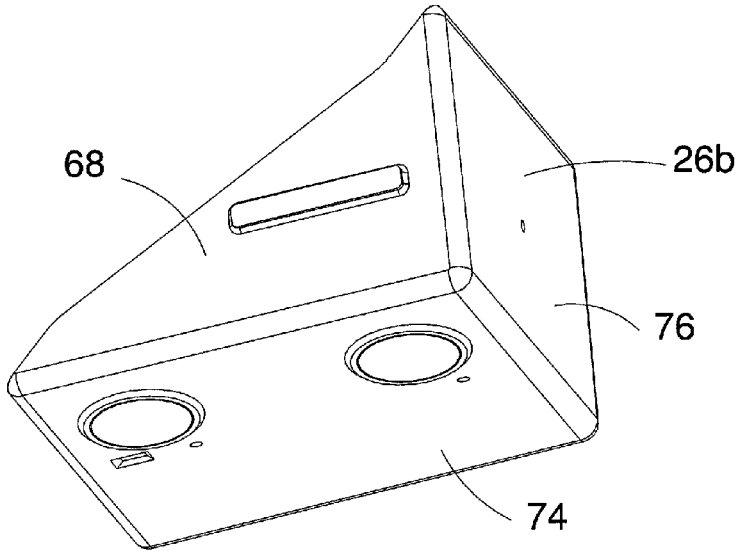
FIG. 7 is a bottom perspective view of the second cavity portion of the split-bodied insulated cavity shown in FIG. 6.

As best seen in FIGS. 2 and 3, first cavity portion 26*a* may either be slidably or fixedly mounted to side walls 12 of file cabinet 10 using a pair of mounting brackets 34. First cavity portion 26*a* may include opposite side walls 66 that are generally triangular-shaped (FIG. 4). Second cavity portion 26*b* is mounted to one of drawer assemblies 22*a*, 22*b*, and is configured to be slidably attached to file cabinet 10 along with its respective drawer assembly. In particular, a pair of tracks 36 are mounted to an outer surface of opposite side walls 68 of second cavity portion 26*b*, wherein tracks 36 are configured to be slidably received within a corresponding pair of channels 38 that are mounted to side walls 12 of file cabinet 10. The side walls 68 of second cavity portion 26*b* may generally be triangular-shaped (FIG. 6). The interaction between tracks 36 and channels 38 allow drawer assembly 22*a*, 22*b* to move between open and closed positions. It should be understood that tracks 36 and channels 38 described herein are conventional, and may be interchanged with other known drawer track configurations known in the art. Further, a drawer cover 40 may be fastened to a front portion of second cavity portion 26*b* and provide a handle 42 to assist a user with opening and closing the drawer assembly 22*a*, 22*b*. A locking assembly 44 also may be mounted to the drawer assembly 22*a*, 22*b* to prevent unauthorized access to file cabinet 10.

Figure 9:
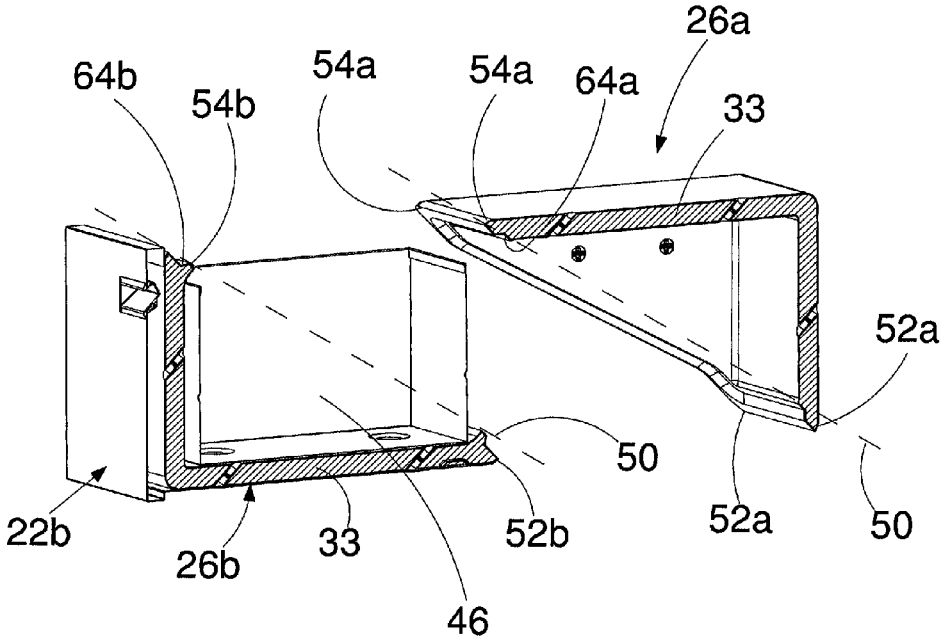
FIG. 9 is a cross-sectional view as shown in FIG. 8 with the drawer in an open position, showing a diagonal mating plane therebetween.

In addition, an open-ended storage box 46 may be positioned within second cavity portion 26*b* to allow for papers, files, or other items to be stored therein. Storage box 46 may be formed of sheet metal, plastic, or some other suitable material that has storage capabilities. Second cavity portion 26*b* is configured to partially surround storage box 46 so that the inside of storage box 46 is accessible when drawer assembly 22*a*, 22*b* is in an open position. However, when drawer assembly 22*a*, 22*b* is moved to a closed position, as best seen in FIGS. 2 and 8, first and second cavity portions 26*a*, 26*b* join together along a mating interface 48 to entirely surround open-ended storage box 46 and the contents located therein to form a localized insulated fire-resistant cavity. Because mating interface 48 may be provided on a diagonal plane 50 (FIG. 9) extending generally from the lower inner corners 52*a*, 52*b* to the upper outer corners 54*a*, 54*b* of first and second cavity portions 26*a*, 26*b*, respectively, storage box 46 is fully accessible when a respective drawer assembly 22*a*, 22*b* is moved to an open position. While mating interface 48 is shown and described as being a diagonal mating surface, it should be understood that other non-diagonal mating surfaces are also within the scope of the present invention.

As best seen in FIGS. 4-9, each first cavity portion 26*a* may include a recess 56 surrounding mating opening 58; and likewise, each second cavity portion 26*b* may include a mating ridge 60 surrounding mating opening 62. A water-resistant seal 64*a*, 64*b*, such as a gasket, may be mounted on at least one of recess 56 and ridge 60 and surround openings 58 and 62, to be disposed at mating interface 48 (FIG. 2). For example, water-resistant seal 64*a*, 64*b* may be formed from an elastomer such as an elastomeric polymerization product of ethylene propylene diene monomer (EPDM) or neoprene. Other types of water resistant seals 64*a*, 64*b* may also be used along mating interface 48 between first and second cavity portions 26*a*, 26*b*.

By providing a file cabinet including a split-bodied fire-resistant cavity in at least one of its file drawer assemblies, numerous advantages are realized. For example, the amount of thermally resistive insulation material that is necessary to protect the contents of the file drawer assembly is substantially less than in the prior art because the need to globally protect the entire housing of the file cabinet is eliminated. The split-bodied fire-resistant cavity allows for the selective use of fire protection for one of the file drawer assemblies, for example, where the other drawer assemblies in the file cabinet are not protected from fire, thereby reducing the amount of insulation material that is needed to manufacture the file cabinet. The present invention is not only less expensive to manufacture because it uses less fire-resistant insulation than in the prior art, but it also provides a local fire-rated space within an otherwise non-fire-rated file cabinet.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A localized split-bodied fire-resistant cavity for a file cabinet, the file cabinet including an outer housing defining an opening for slidably receiving at least one file drawer assembly therein, the split-bodied fire-resistant cavity comprising:

a first cavity portion configured to be mounted to the outer housing of the file cabinet, the first cavity portion including opposite side walls that are both generally triangular-shaped, the first cavity portion further including a lower inner corner and an upper outer corner;

a second cavity portion configured to be mounted to the file drawer assembly, the second cavity portion including opposite side walls that are both generally triangular-shaped, the second cavity portion further including a lower inner corner and an upper outer corner; and a mating interface between said first and second cavity portions, wherein the mating interface is disposed on a diagonal plane, wherein the diagonal plane extends generally from the lower inner corners of the first and second cavity portions to the upper outer corners of the first and second cavity portions, and wherein the first and second cavity portions are configured to join together at the mating interface to define a localized fire-resistant space when the at least one file drawer assembly is in a closed position.

2. A localized split-bodied fire-resistant cavity in accordance with claim 1, wherein at least one of the first and second cavity portions include an outer wall and an inner wall defining an insulation space therebetween.

3. A localized split-bodied fire-resistant cavity in accordance with claim 2, wherein a thermally insulative fire-resistant material is positioned within the insulation space.

4. A localized split-bodied fire-resistant cavity in accordance with claim 1, further comprising an open-ended storage box disposed within the second cavity portion, wherein the second cavity portion is configured to surround a portion of the open-ended storage box, wherein the first and second cavity portions are configured to join together at the mating interface to entirely surround the open-ended storage box when the at least one file drawer assembly is in the closed position.

5. A localized split-bodied fire-resistant cavity in accordance with claim 4, wherein the open-ended storage box is formed of sheet metal.

6. A localized split-bodied fire-resistant cavity in accordance with claim 1, wherein one of the first and second cavity portions includes a mating recess, and the other of the first and second cavity portions has a mating ridge formed therein, wherein the mating ridge is positioned within the mating recess along the mating interface.

7. A localized split-bodied fire-resistant cavity in accordance with claim 6, wherein a gasket is positioned within the mating recess.

8. A localized split-bodied fire-resistant cavity in accordance with claim 1, wherein the first cavity portion is configured to be fixedly mounted to the outer housing of the file cabinet.

9. A localized split-bodied fire-resistant cavity in accordance with claim 1, further including a pair of tracks mounted to an outer surface of the side walls of the second cavity portion, wherein the pair of tracks are configured for being slidably received in corresponding channels defined in the outer housing.

10. A file cabinet comprising:

an outer housing defining an opening;

at least one file drawer assembly slidably disposed within the opening of the outer housing, the at least one file drawer assembly including an open-ended storage box; and a split-bodied fire-resistant cavity including first and second cavity portions, wherein the first cavity portion is mounted to the outer housing, wherein the first cavity portion includes opposite side walls that are both generally triangular-shaped, wherein the first cavity portion includes a lower inner corner and an upper outer corner, wherein the second cavity portion is mounted to the file drawer assembly and is configured to surround a portion of the open-ended storage box, wherein the second cavity portion includes opposite side walls that are both generally triangular-shaped, wherein the second cavity portion includes a lower inner corner and an upper outer corner, wherein a mating interface is provided between the first and second cavity portions, wherein the mating interface is disposed on a diagonal plane, wherein the diagonal plane extends generally from the lower inner corners of the first and second cavity portions to the upper outer corners of the first and second cavity portions, wherein the open-ended storage box is accessible when the at least one file drawer assembly is in an open position, and wherein the first and second cavity portions are configured to join together at the mating interface to entirely surround the open-ended storage box when the at least one file drawer assembly is in a closed position.

11. A file cabinet in accordance with claim 10, wherein at least one of the first and second cavity portions include an outer wall and an inner wall defining an insulation space therebetween.

12. A file cabinet in accordance with claim 11, wherein a thermally insulative fire-resistant material is positioned within the insulation space.

13. A file cabinet in accordance with claim 10, wherein the open-ended storage box is formed of sheet metal.

14. A file cabinet in accordance with claim 10, wherein one of the first and second cavity portions includes a mating recess, and the other of the first and second cavity portions has a mating ridge formed therein, wherein the mating ridge is positioned within the mating recess along the mating interface.

15. A file cabinet in accordance with claim 14, wherein a gasket is positioned within the mating recess.

16. A file cabinet in accordance with claim 10, wherein the first cavity portion is fixedly mounted to the outer housing.

17. A file cabinet in accordance with claim 10, further including a pair of tracks mounted to an outer surface of the side walls of the second cavity portion, wherein the pair of tracks are configured for being slidably received in corresponding channels defined in the outer housing.

18. A localized split-bodied fire-resistant cavity for a file cabinet, the file cabinet including an outer housing defining an opening for slidably receiving at least one file drawer assembly therein, the split-bodied fire-resistant cavity comprising:

a first cavity portion configured to be mounted to the outer housing of the file cabinet, the first cavity portion including a top wall, a back wall, and opposite side walls, wherein the top wall and the back wall are connected to the opposite side walls of the first cavity portion, and wherein the opposite side walls are generally triangular-shaped;

a second cavity portion configured to be mounted to the file drawer assembly, the second cavity portion including a bottom wall, a front wall, and opposite side walls, wherein the bottom wall and the front wall are connected to the opposite side walls of the second cavity portion, and wherein the opposite side walls of the second cavity portion are generally triangular-shaped; and a mating interface between said first and second cavity portions, wherein the first and second cavity portions are configured to join together at the mating interface to define a localized fire-resistant space when the at least one file drawer assembly is in a closed position.

19. A localized split-bodied fire-resistant cavity in accordance with claim 18, wherein at least one of the first and second cavity portions include an outer wall and an inner wall defining an insulation space therebetween, wherein a thermally insulative fire-resistant material is positioned within the insulation space.

20. A localized split-bodied fire-resistant cavity in accordance with claim 18, further comprising an open-ended storage box disposed within the second cavity portion, wherein the second cavity portion is configured to surround a portion of the open-ended storage box, wherein the first and second cavity portions are configured to join together at the mating interface to entirely surround the open-ended storage box when the at least one file drawer assembly is in the closed position.

21. A localized split-bodied fire-resistant cavity in accordance with claim 18, wherein the mating interface is a diagonal mating interface.

22. A localized split-bodied fire-resistant cavity in accordance with claim 18, wherein one of the first and second cavity portions includes a mating recess, and the other of the first and second cavity portions has a mating ridge formed therein, wherein the mating ridge is positioned within the mating recess along the mating interface.

* * * * *